US012168253B2

(12) United States Patent
Musha et al.

(10) Patent No.: US 12,168,253 B2
(45) Date of Patent: Dec. 17, 2024

(54) METHOD OF MANUFACTURING RING-ROLLED ELEMENT

(71) Applicant: PROTERIAL, LTD., Tokyo (JP)

(72) Inventors: Kazuya Musha, Tokyo (JP); Jun Ohsone, Tokyo (JP); Yuji Ishiwari, Tokyo (JP); Momoko Oji, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 186 days.

(21) Appl. No.: 17/787,865

(22) PCT Filed: Dec. 16, 2020

(86) PCT No.: PCT/JP2020/046953
§ 371 (c)(1),
(2) Date: Jun. 21, 2022

(87) PCT Pub. No.: WO2021/131963
PCT Pub. Date: Jul. 1, 2021

(65) Prior Publication Data

US 2023/0043008 A1 Feb. 9, 2023

(30) Foreign Application Priority Data

Dec. 25, 2019 (JP) ..... 2019-234875

(51) Int. Cl.
*B21H 1/06* (2006.01)

(52) U.S. Cl.
CPC ..... *B21H 1/06* (2013.01)

(58) Field of Classification Search
CPC ..... B21D 53/16; B21H 1/06
See application file for complete search history.

(56) References Cited

U.S. PATENT DOCUMENTS 1,971,027 A * 8/1934 Bell ..... B21H 1/06 72/87
2017/0297080 A1* 10/2017 Ishiwari ..... B21J 5/02

FOREIGN PATENT DOCUMENTS

CN 1586754 A 3/2005
CN 101081426 A 12/2007
(Continued)

OTHER PUBLICATIONS

Translation of CN-106903244 (Year: 2017).*
(Continued)

*Primary Examiner* — Bobby Yeonjin Kim
(74) *Attorney, Agent, or Firm* — Myers Bigel, P.A.

(57) ABSTRACT

Provided is a ring-rolled member manufacturing method enabling stabilization of the attitude of the ring material without generating a defect and the like in the resulting ring-rolled member even when the main roll of the ring-rolling device is provided with the flange portions positioned on upper and lower sides of the ring material. A ring-rolling device used in the ring-rolled member manufacturing method of the present invention is provided with a main roll 10 and a mandrel roll 20. An outer peripheral face of the main roll includes a recessed portion 12 to accommodate the ring material and an outer peripheral face of the mandrel roll 20, an upper flange portion 11 positioned on an upper side thereof, and a lower flange portion 13 positioned on a lower side thereof. An inner face of the recessed portion includes a rolling face 12S to be in contact with an outer peripheral face of the ring material, an upper face on the upper flange portion side, and a lower face 13S on the lower flange portion side, the lower face 13S having a slope in such a way that an opening of the recessed portion 12 is enlarged. The slope starts from within a range of a distance corresponding to a thickness of the ring-rolled member from a line of intersection between the lower face 13S and the rolling face
(Continued)

12S. An angle of the slope is greater than 0.3° and no greater than 9° with reference to the perpendicular plane.

5 Claims, 3 Drawing Sheets

(56) References Cited

FOREIGN PATENT DOCUMENTS

| | | | | | |
|---|---|---|---|---|---|
| CN | 101279346 | A | | 10/2008 | |
| CN | 101279347 | A | | 10/2008 | |
| CN | 101279348 | A | | 10/2008 | |
| CN | 101279349 | A | | 10/2008 | |
| CN | 101284296 | A | * | 10/2008 | |
| CN | 105283697 | A | | 1/2016 | |
| CN | 205183628 | U | | 4/2016 | |
| CN | 106903244 | A | * | 6/2017 | ..... B21H 1/06 |
| CN | 107127279 | A | | 9/2017 | |
| CN | 106903244 | B | | 7/2018 | |
| CN | 108907045 | A | | 11/2018 | |
| CN | 208083300 | U | | 11/2018 | |
| EP | 2979774 | A1 | | 2/2016 | |
| JP | 2011056548 | A | | 3/2011 | |
| JP | 2013169563 | A | | 9/2013 | |
| JP | 2014188580 | A | | 10/2014 | |
| JP | 5895111 | B1 | | 3/2016 | |

OTHER PUBLICATIONS

Translation of CN-101284296 (Year: 2008).*

"International Search Report and English language translation", International Application No. PCT/JP2020/046953, Jan. 26, 2021, 5 pp.

"Communication with Supplementary European Search Report", EP Application No. 20908430.0, May 15, 2023, 7 pp.

"First Office Action and English language translation", CN Application No. 202080089438.5, Feb. 26, 2024, 13 pp.

"Second Office Action and English language translation", CN Application No. 202080089438.5, Jul. 26, 2024, 12 pp.

* cited by examiner

METHOD OF MANUFACTURING RING-ROLLED ELEMENT

RELATED APPLICATIONS

This application is a 35 U.S.C. § 371 national stage application of PCT Application No. PCT/JP2020/046953, filed on Dec. 16, 2020, which itself claims priority to Japanese Patent Application No. 2019-234875, filed on Dec. 25, 2019, the contents of which are incorporated herein by reference in their entireties. The above-referenced PCT International Application was published in the Japanese language as International Publication No. WO 2021/131963 A1 on Jul. 1, 2021.

TECHNICAL FIELD

The present invention relates to a method for manufacturing a ring-rolled member.

BACKGROUND ART

As a method for manufacturing a ring-rolled member by ring-rolling a ring material, for example, as disclosed in JP 5895111 B1, a method has been known in which a main roll and a mandrel roll are respectively brought into contact with an outer peripheral face and an inner peripheral face of a ring material having a ring-like shape, the ring material is sandwiched and compressed in a radial direction of the ring material by the main roll and the mandrel roll being respectively rotated around their central axes, and the ring material is sandwiched and compressed by a pair of axial rolls in a central axis direction of the ring material, whereby a ring-rolled member is manufactured.

In addition, as a ring-rolled member manufacturing method, for example, CN 107127279 A discloses a ring-rolling method in which a main roll is provided with a lower supporting plate positioned below a ring material and an upper compression plate positioned above the ring material, and an upper compression plate adjustment ring member adjusts the position of the upper compression plate to be compatible with ring materials with different heights.

REFERENCE DOCUMENT LIST

Patent Document

Patent Document 1: JP 5895111 B1
Patent Document 2: CN 107127279 A

SUMMARY OF THE INVENTION

Problem to be Solved by the Invention

In the case of ring-rolling a ring material, especially when the ring material has a tapered shape or such a shape that thickness thereof is partially different, resistance generated by a difference in peripheral speed between the main roll and the mandrel roll, which are dies, and the ring material, and a difference in an increase in diameter between a thick-walled portion and a thin-walled portion, lead to a problem of an attitude of the ring material being difficult to stabilize during the ring-rolling. When rotation of the ring material is unstable, the ring material may be excessively brought into contact with the axial roll and a table, leading to problems of generation of a defect, deflection of the shape of the ring-rolled member after the rolling, and the like.

In order to stabilize the rotation of the ring material, a method of providing the main roll with flange portions positioned on upper and lower sides of the ring material to stabilize the attitude of the ring material may be employed; however, if the ring material is churned during the ring-rolling and comes into contact with the main roll including the flange portions and the mandrel roll, a problem may occur such as a defect, for example, a burr, is generated in the resulting ring-rolled member, or an increased burden on the ring-rolling device due to an impact of such contact. Therefore, in the case of providing the main roll with the flange portions as described above, it has been necessary to prepare a plurality of patterns of the shape of the main roll including the flange portions (so-called die) and carry out the ring-rolling while adjusting contact with the ring material, and to carry out the ring-rolling little by little through a large number of steps of heating and then ring-rolling the ring material (increasing so-called heat number) in order to alleviate the burden on the device, for example.

In view of the above-described problems, an object of the present invention is to provide a ring-rolled member manufacturing method enabling stabilization of the attitude of the ring material during rolling without generating a defect and the like in the resulting ring-rolled member even when the main roll is provided with the flange portions positioned on upper and lower sides of the ring material.

Means for Solving the Problem

In order to achieve the aforementioned object, the present invention provides a ring-rolled member manufacturing method of manufacturing a ring-rolled member by ring-rolling a ring material with a ring-rolling device, in which: the ring-rolling device is provided with a main roll and a mandrel roll; an outer peripheral face of the main roll includes a recessed portion to accommodate the ring material and an outer peripheral face of the mandrel roll, a first flange portion positioned on one side in a central axis direction of the main roll with respect to the recessed portion, and a second flange portion positioned on an opposite side of the first flange portion; an inner face of the recessed portion includes a rolling face to be in contact with an outer peripheral face of the ring material, a first inner face on a side of the first flange portion, and a second inner face on a side of the second flange portion; and at least one inner face among the first inner face and the second inner face has a slope in such a way that an opening of the recessed portion is enlarged, with reference to a perpendicular plane perpendicularly intersecting the central axis direction of the main roll. The slope starts from within a range of a distance corresponding to a thickness of the ring-rolled member from a line of intersection between the at least one inner face and the rolling face. In other words, a distance between the line of intersection between the at least one inner face and the rolling face and a terminal of the slope on the side of the rolling face is less than the thickness of the ring-rolled member. An angle of the slope is greater than 0.3° and no greater than 9° with reference to the perpendicular plane.

The ring material is preferably a heat-resistant alloy, which is a Ni-based alloy, a Co-based alloy, or an Fe-based alloy.

The outer peripheral face of the ring material may be at least partially inclined with respect to a central axis of the ring material, and in this case, an angle between a straight line connecting an end face corner of a large-diameter outer periphery with an end face corner of a small-diameter outer periphery of the ring material and the central axis of the ring material may be greater than 10°. In addition, when the angle of the inclination is greater than 10°, the angle of the slope of the inner face is preferably no less than 0.6° and no greater than 9° with reference to the perpendicular plane. The lower limit of the angle of the slope is preferably no less than 0.8°, and more preferably no less than 1°. The upper limit of the angle of the slope is preferably no greater than 4°, and more preferably no greater than 3°.

The outer peripheral face of the ring material may be at least partially inclined with respect to a central axis of the ring material, and in this case, an angle between a straight line connecting an end face corner of a large-diameter outer periphery with an end face corner of a small-diameter outer periphery of the ring material and the central axis of the ring material may be no greater than 10°. In addition, when the angle of the inclination is no greater than 10°, the angle of the slope of the inner face is preferably greater than 0.3° and less than 3° with reference to the perpendicular plane. The lower limit of the preferred angle of the slope is preferably no less than 0.5°, and more preferably no less than 0.6°. The upper limit of the angle of the slope is preferably no greater than 2.5°, and more preferably no greater than 2°.

Effects of the Invention

As described above, in the present invention, the outer peripheral face of the main roll includes the recessed portion to accommodate the ring material and the outer peripheral face of the mandrel roll, and the at least one inner face among the first inner face on the side of the first flange portion and the second inner face on the side of the second flange portion of the recessed portion has the slope on an entire face thereof or in a predetermined part thereof, in such a way that the opening of the recessed portion is enlarged, whereby the ring material being rotated is appropriately constrained and an attitude thereof can be stabilized, enabling smooth ring-rolling. As a result, it is not required to prepare a plurality of patterns of dies or increase the heat number, whereby the cost required for the ring-rolling can be reduced. In particular, even in the case in which the ring material has a tapered shape or has such a shape that thickness thereof is partially different, the attitude of the ring material can be stabilized, whereby a nearly net shape can be given to the resulting ring-rolled member and an input weight of the ring material can be reduced.

MODE FOR CARRYING OUT THE INVENTION

Hereinafter, an embodiment of the ring-rolled member manufacturing method according to the present invention is explained with reference to the attached drawings. Note that the drawings put emphasis on clearly illustrating the embodiment of the present invention and are not necessarily drawn to scale.

In the ring-rolled member manufacturing method according to the present embodiment, the ring-rolling device shown in FIG. 1 to FIG. 4 is used, for example. The ring-rolling device is provided with a main roll 10 and a mandrel roll 20 that are positioned respectively on an outer peripheral side and an inner peripheral side of a ring material 1, which is a rolling target, having a ring-like shape. An outer peripheral face of the main roll 10 and an outer peripheral face of the mandrel roll 20 face each other across the ring material 1. The main roll 10 is configured to be rotatable around a central axis 10X thereof, and the mandrel roll 20 is also configured to be rotatable around a central axis 20X thereof. The central axis 10X of the main roll 10 and the central axis 20X of the mandrel roll 20 are substantially parallel. The main roll 10 and the mandrel roll 20 are configured to roll the ring material 1 in a radial direction of the ring-like shape (hereinafter referred to as "ring radial direction") therebetween, and the mandrel roll 20 is configured to be movable along the ring radial direction with respect to the main roll 10. Note that the central axis direction of the main roll and the central axis direction of the ring material correspond to each other.

Figure 1:
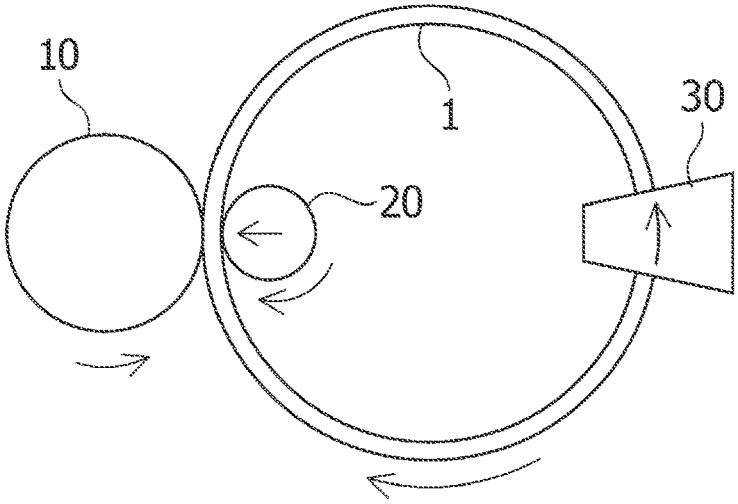
FIG. 1 is a plan view schematically showing an example of a ring-rolling device used in the ring-rolled member manufacturing method according to the present invention.
Figure 2:
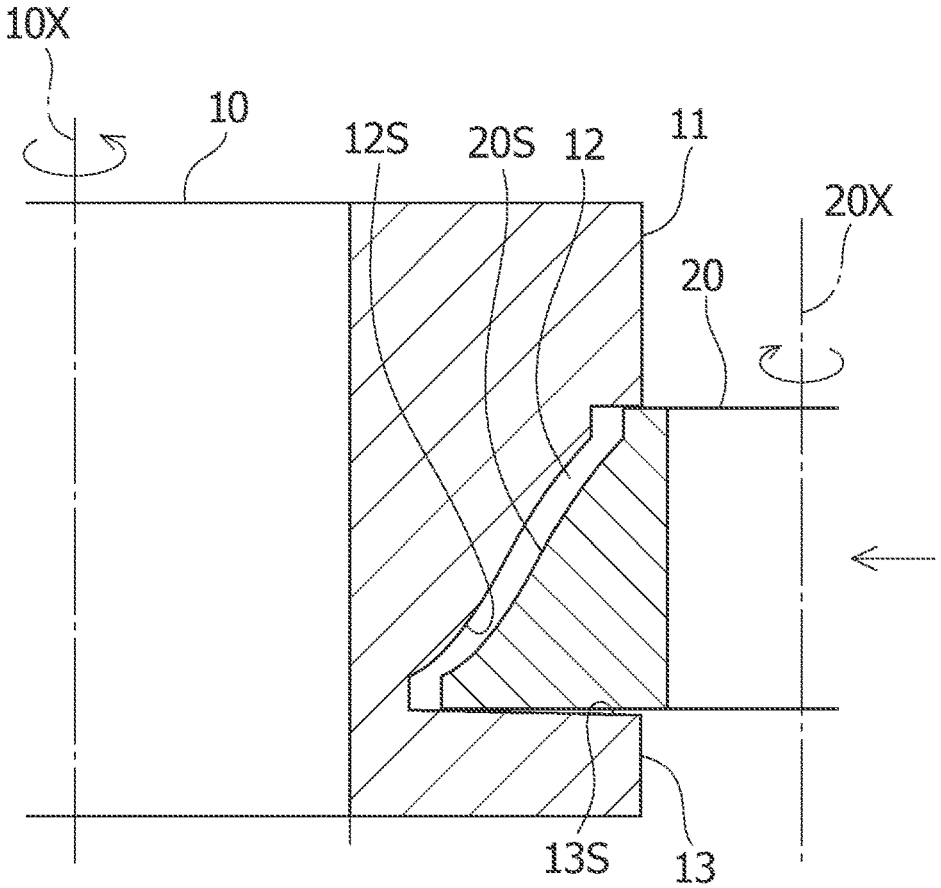
FIG. 2 is a partially enlarged cross-sectional view schematically showing a main roll and a mandrel roll in the ring-rolling device in FIG. 1.

In addition, the ring-rolling device is provided with a pair of axial rolls 30 positioned to sandwich the ring material 1 in the central axis direction of the ring-like shape (hereinafter referred to as "ring axis direction"). Note that, in the present specification, for the sake of simplicity of explanation, the upper side and the lower side in FIG. 2 are referred to as "upper side" and "lower side", respectively, along the central axis 10X or the central axis 20X. Note that the pair of axial rolls 30 are positioned on the upper and lower sides of the ring material 1. The pair of axial rolls 30 are configured to roll the ring material 1 in the ring axis direction, and outer peripheral faces of the pair of axial rolls 30 face each other across the ring material 1. The pair of axial rolls 30 are configured to be rotatable around the respective central axes thereof.

The outer peripheral face of the main roll 10 includes a substantially U-shaped recessed portion 12 to accommodate the ring material 1, which is the rolling target, and the outer peripheral face of the mandrel roll 20, a first flange portion (hereinafter referred to as "upper flange portion") 11 positioned on one side in the central axis direction of the main roll, and a second flange portion (hereinafter referred to as "lower flange portion") 13 positioned on an opposite side of the first flange portion 11. In addition, an inner face of the recessed portion 12 of the main roll 10 includes a rolling face 12S to be in contact with the outer peripheral face of the ring material 1, a first inner face (hereinafter referred to as "upper face") 11S on a side of the upper flange portion 11, and a second inner face (hereinafter referred to as "lower face") 13S on a side of the lower flange portion 13.

The rolling face 12S of the recessed portion 12 of the main roll 10 is inclined to correspond to the outer peripheral face of the ring-rolled member after the rolling. In a similar manner, the outer peripheral face 20S of the mandrel roll 20 is also inclined to correspond to the inner peripheral face of the ring-rolled member after the rolling. As shown in FIG. 2, a gap between the rolling face 12S of the recessed portion 12 of the main roll 10 and the outer peripheral face 20S of the mandrel roll 20 has a shape of the ring-rolled member after the rolling. As described above, the rolling face 12S of the recessed portion 12 of the main roll 10 and the outer peripheral face 20S of the mandrel roll 20 correspond respectively to desired shapes of the outer peripheral face and the inner peripheral face of the ring-rolled member, and may be inclined in a linear shape, a curved shape, or a combination thereof.

The thickness of the ring-rolled member is not required to be uniform, and therefore the inclinations of the outer peripheral face and the inner peripheral face of the ring-rolled member are not required to be at the same angle.

The lower face 13S of the recessed portion 12 of the main roll 10 has, as shown in FIG. 2, a slope in such a way that the opening of the recessed portion 12 is enlarged toward the outer peripheral side of the main roll 10. Note that, in FIG. 2, since the lower face 13S is larger in area than the upper face 11S, the lower face 13S has the slope; however, depending on the desired shape of the ring-rolled member, in a case in which the upper face 11S is larger in area than the lower face 13S, the upper face 11S has a slope in such a way that the opening of the recessed portion 12 is enlarged toward the outer peripheral side. Alternatively, not only one of the upper face 11S and the lower face 13S, but both of the upper face 11S and the lower face 13S may have slopes.

Figure 3:
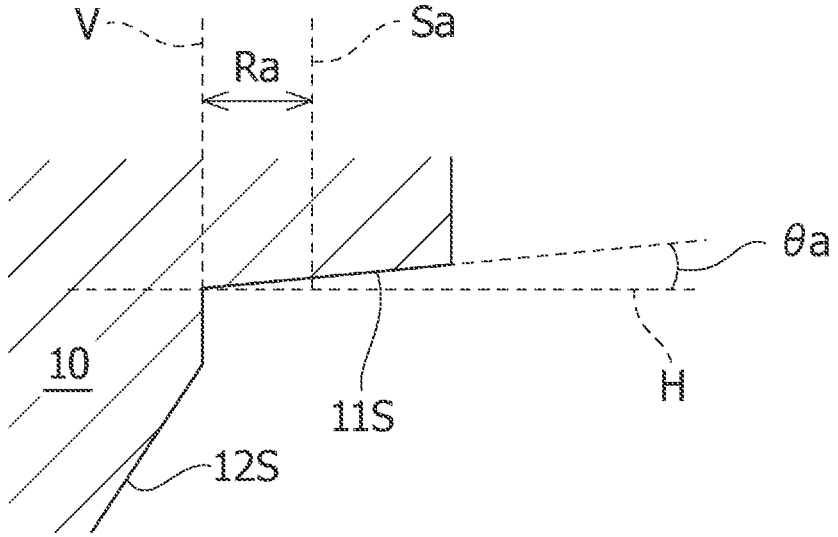
FIG. 3 is a cross-sectional view showing in an enlarged manner a part showing an upper flange of the main roll in FIG. 2.

The slope angle θa of the upper face 11S is indicated by, as shown in FIG. 3, an angle between a perpendicular plane H perpendicularly intersecting the central axis direction of the main roll (typically a horizontal face in the ring radial direction) and the upper face 11S. The lower limit of the slope angle θa of the upper face 11S varies according to an inclination angle, which is described later, of the ring material, but is preferably greater than 0.3°, more preferably no less than 0.5°, still more preferably no less than 0.6°, and further more preferably no less than 1°. In addition, the upper limit of the slope angle θa of the upper face 11S is preferably no greater than 9°, more preferably less than 5°, still more preferably no greater than 3°, and further more preferably no greater than 2°.

In addition, the slope of the upper face 11S is provided, as shown in FIG. 3, from a line of intersection V with the rolling face 12S of the recessed portion 12 of the main roll 10 to an end on the outer peripheral side (in other words, on an entire face of the upper face 11S); however, in order to produce the effects of the invention, it is only required to provide the slope, not from the line of intersection V with the rolling face 12S, but from a position Sa of the inner peripheral face of the desired ring-rolled member after rolling to the end on the outer peripheral side (in other words, a distance between the line of intersection V and the position Sa is a thickness Ra of an upper end portion of the desired ring-rolled member). In other words, a distance between the line of intersection V between the upper face 11S and the rolling face 12S and a terminal of the slope of the upper face 11S on the side of the rolling face 12S is less than the thickness Ra of the ring-rolled member.

Figure 4:
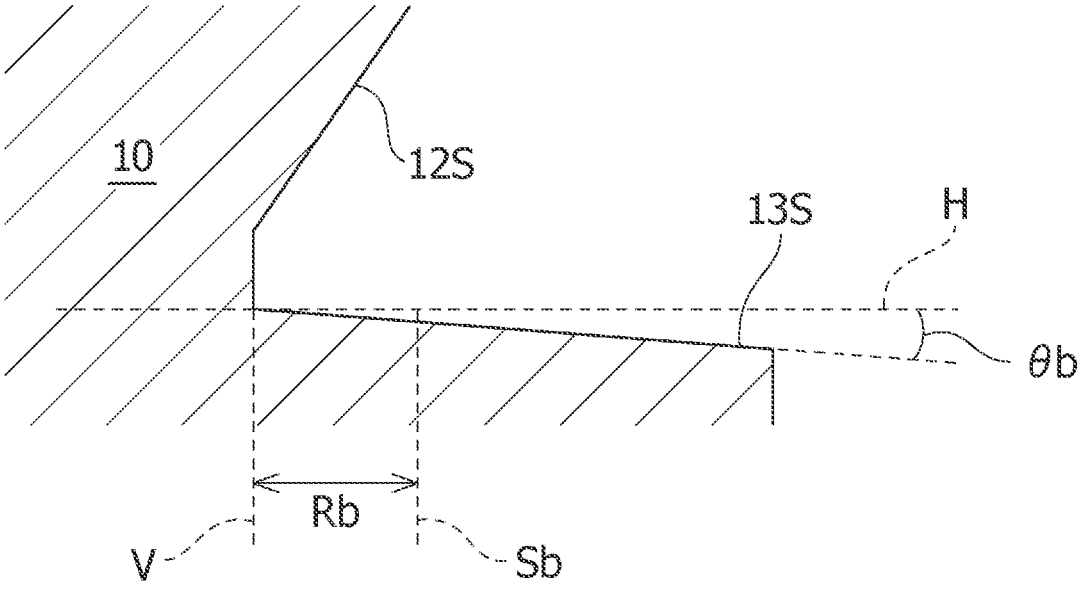
FIG. 4 is a cross-sectional view showing, in an enlarged manner, a part showing a lower flange of the main roll in FIG. 2.

The slope angle θb of the lower face 13S is indicated by, as shown in FIG. 4, an angle between the perpendicular plane H perpendicularly intersecting the central axis direction of the main roll 10 (typically a horizontal face in the ring radial direction) and the lower face 13S. The lower limit of the slope angle θb of the lower face 13S varies according to an inclination angle, which is described later, of the ring material, but is preferably no less than 0.3°, more preferably no less than 0.5°, still more preferably no less than 0.6°, and further more preferably no less than 1°. The upper limit of the slope angle θb of the lower face 13S varies according to an inclination angle, which is described later, of the ring material, but is preferably less than 9°, more preferably less than 5°, still more preferably less than 3°, and further more preferably less than 2°.

In addition, the slope of the lower face 13S is provided, as shown in FIG. 4, from a line of intersection V with the rolling face 12S of the recessed portion 12 of the main roll 10 to an end on the outer peripheral side (in other words, on an entire face of the lower face 13S); however, in order to produce the effects of the invention, it is only required to provide the slope, not from the line of intersection V with the rolling face 12S, but from a position Sb of the inner peripheral face of the desired ring-rolled member after rolling to the end on the outer peripheral side (in other words, a distance between the line of intersection V and the position Sb is a thickness Rb of a lower end portion of the desired ring-rolled member). In other words, a distance between the line of intersection V between the lower face 13S and the rolling face 12S and a terminal of the slope of the lower face 13S on the side of the rolling face 12S is less than the thickness Rb of the ring-rolled member.

In order to manufacture a ring-rolled member by using such a ring-rolling device, first, the ring material 1 is loaded to the ring-rolling device. As the ring material 1, a material formed from a heat-resistant alloy such as a Ni-based alloy, a Co-based alloy, and an Fe-based alloy is suitable. Since hot ductility of the heat-resistant alloy is significantly reduced due to a decrease in temperature, a temperature range in which the heat-resistant alloy can be plastically processed is extremely narrow. In other words, the heat-resistant alloy is rollable only for a short period of time. Therefore, the ring-rolling device according to the present embodiment enabling rolling in a stable attitude provides a profound effect. The heating temperature for the ring material 1 loaded to the ring-rolling device varies according to the material of the ring material 1. For example, in a case of the ring material 1 being formed from Alloy 718, which is a Ni-based alloy, the heating temperature is preferably in a range from 1000° C. to 1050° C.; however, the heating temperature may vary according to a demand of a product and is not limited to this range.

Figure 5:
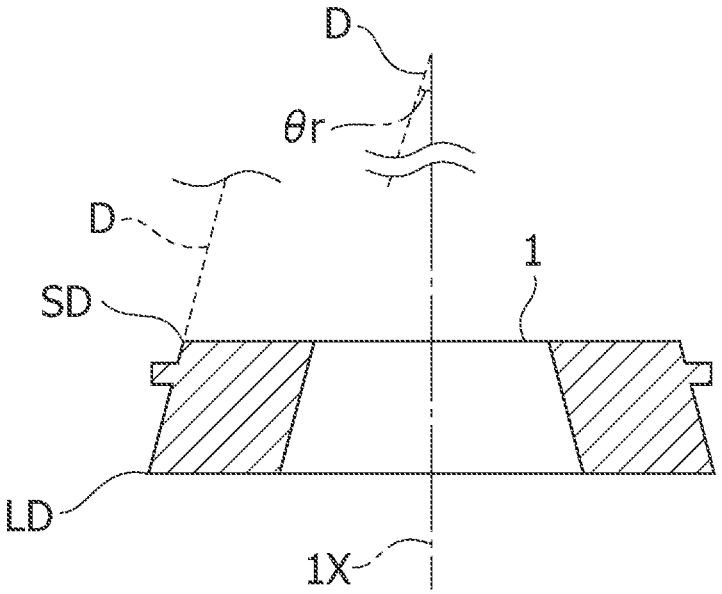
FIG. 5 is a cross-sectional view schematically showing an example of a ring material used in the ring-rolled member manufacturing method according to the present invention.

In addition, the shape of the ring material 1 to be loaded may be, for example, a so-called tapered ring with an outer peripheral face and an inner peripheral face being linearly inclined substantially uniformly, and a so-called odd-shaped ring being inclined in a curved shape or in a combination of a linear shape and a curved shape, or having a thickness which is partially different. The inclination angle θr of the ring material 1 as described above is indicated by, even in the case in which the thickness of a part of the ring material is different as shown in FIG. 5, in the case of the tapered ring, an angle between a line D connecting an end face corner LD of a large-diameter outer periphery with an end face corner SD of a small-diameter outer periphery of the ring material 1, and the central axis 1X of the ring shape of the ring material 1. The lower limit of the inclination angle θr of the ring material 1 is preferably no less than 5°, more preferably no less than 7°, still more preferably greater than 10°, and further more preferably no less than 15°. The upper limit of the inclination angle θr of the ring material 1 is not particularly limited, and preferably no greater than 40°, more preferably no greater than 35°, and still more preferably no greater than 30°. The ring material 1 to be loaded may be, of course, a so-called rectangular ring without inclination.

Thereafter, the outer peripheral face of the main roll 10 and the outer peripheral face of the mandrel roll 20 are brought into contact with the outer peripheral face and the inner peripheral face of the ring material 1, and the outer peripheral faces of the pair of axial rolls 30 are brought into contact with both of the upper and lower end faces of the ring material 1 respectively. While the main roll 10 and the mandrel roll 20 are rotated in the directions of the arrows shown in FIG. 1 and FIG. 2, the mandrel roll 20 is moved toward the main roll 10, whereby the main roll 10 and the mandrel roll 20 sandwich and compress the ring material 1 in the ring radial direction. In addition, while the pair of axial rolls 30 are rotated in the direction of the arrow shown in FIG. 1, the pair of axial rolls 30 sandwich and compress the ring material 1 in the ring axis direction. The ring material 1 is thus ring-rolled to yield a ring-rolled member.

In this case, even when the ring material 1 is a tapered ring or an odd-shaped ring, since the lower face 13S of the recessed portion 12 of the main roll 10 has a slope in such a way that the opening of the recessed portion 12 is enlarged toward the outer peripheral side of the main roll 10 as shown in FIG. 2, the attitude of the ring material 1 accommodated in the recessed portion 12 of the main roll 10 is stabilized by the lower face 13S and the upper face 11S of the recessed portion 12, whereby stable rotation of the ring material 1 around the central axis 1X is enabled. This can suppress excessive contact of the ring material 1 with the axial roll 30 and the like, and in turn prevent generation of a defect. In particular, with the ring material 1 in which the inclination angle θr is greater than 10°, stabilization of attitude during the ring-rolling is difficult due to a difference in peripheral speed between the die and the material, and therefore, the effect of the invention is remarkable. In addition, in a case in which the outer peripheral faces of the main roll 10 and the mandrel roll 20 have predetermined shapes for obtaining an odd-shaped ring, stabilization of attitude during the ring-rolling is difficult due to a difference in an increase in diameter between a thick-walled portion and a thin-walled portion, and therefore, the effect of the invention is remarkable.

EXAMPLES

An Example of the present invention is described hereinafter. First, a test of providing an entire lower face of the recessed portion of the main roll of the ring-rolling device with a slope of a slope angle θb from 0° to 12° respectively, as shown in Table 1, and then ring-rolling the ring material was carried out. The test was carried out for two types of ring material: a tapered ring with an inclination angle of greater than 10°; and a tapered ring with an inclination angle of no greater than 10°. Then, stability of the ring material during the ring-rolling, and defects in a resulting ring-rolled member were evaluated. The results are also shown in Table 1.

In addition, a test of providing an entire lower face of the recessed portion of the main roll of the ring-rolling device with a slope of a slope angle θb of 1.5°, providing an entire upper face of the recessed portion of the main roll with a slope of a slope angle θa from 0° to 12° respectively, as shown in Table 2, and then ring-rolling the ring material was carried out. In a similar manner to the foregoing, the test was carried out for two types of ring material: a tapered ring with an inclination angle of greater than 10°; and a tapered ring with an inclination angle of no greater than 10°. Then, stability of the ring material during the ring-rolling, and a defect in a resulting ring-rolled member were evaluated. The results are also shown in Table 2.

TABLE 1

| Ring material with inclination angle no greater than 10° | | | Ring material with inclination angle greater than 10° | | |
|---|---|---|---|---|---|
| Slope angle θb of lower face | Rolling stability | Defects | Slope angle θb of lower face | Rolling stability | Defect |
| 0° | Poor | Poor | 0° | Poor | Poor |
| 0.1° | Poor | Fair | 0.1° | Poor | Poor |
| 0.3° | Fair | Good | 0.3° | Fair | Fair |
| 0.6° | Excellent | Excellent | 0.6° | Good | Excellent |
| 1° | Excellent | Excellent | 1° | Excellent | Excellent |
| 2° | Good | Good | 2° | Excellent | Excellent |
| 3° | Fair | Fair | 3° | Excellent | Fair |
| 5° | Fair | Fair | 5° | Good | Fair |
| 9° | Fair | Poor | 9° | Good | Fair |
| 12° | Poor | Poor | 12° | Poor | Poor |

TABLE 2

| Ring material with inclination angle no greater than 10° | | | Ring material with inclination angle greater than 10° | | |
|---|---|---|---|---|---|
| Slope angle θa of upper face | Rolling stability | Defects | Slope angle θa of upper face | Rolling stability | Defect |
| 0° | Poor | Poor | 0° | Poor | Poor |
| 0.1° | Poor | Good | 0.1° | Poor | Poor |
| 0.3° | Fair | Excellent | 0.3° | Poor | Fair |
| 0.6° | Excellent | Excellent | 0.6° | Good | Excellent |
| 1° | Excellent | Excellent | 1° | Excellent | Excellent |
| 2° | Excellent | Good | 2° | Excellent | Excellent |
| 3° | Fair | Fair | 3° | Excellent | Fair |
| 5° | Fair | Fair | 5° | Good | Fair |
| 9° | Fair | Poor | 9° | Good | Fair |
| 12° | Poor | Poor | 12° | Poor | Poor |

With regard to "Rolling Stability" in the Tables, behavior of the ring material during the ring-rolling was observed by shooting a video from an upper direction and a lateral direction of the ring material, and an evaluation of "Excellent" was given when abnormal behavior (slipping, heaving, vibrating) of the ring material was not observed during the ring-rolling, an evaluation of "Good" was given when a degree of the abnormal behavior was small, and an evaluation of "Poor" was given when a degree of the abnormal behavior was great (rolling to a desired diameter was not possible within a target period of time and rolling was stopped in the middle). An evaluation of "Fair" was given for a case between "Good" and "Poor".

With regard to "Defects" in Tables, a defect in the resulting ring-rolled member was removed by a grinder, weight reduction after defect removal was measured, and an evaluation of "Excellent" was given when the weight loss was less than 0.1% with respect to the weight of the ring material, an evaluation of "Good" was given when the weight reduction was no less than 0.1% and less than 0.3%, an evaluation of "Fair" was given when the weight loss was no less than 0.3% and less than 1.5%, and an evaluation of "Poor" was given when the weight loss was no less than 1.5%.

As shown in Table 1 and Table 2, when both of the lower face and the upper face of the recessed portion of the main roll had a very small slope angle of 0.1°, constriction of the ring material by the lower face and the upper face was too strong and caused resistance against rotation of the ring material, resulting in unstable rotation. In contrast, when the slope angle was far too greater of 10°, retention of the ring material was insufficient and the ring material had a tilted attitude, resulting in an increase in instability of rotation due to friction with the main roll.

In addition, when the ring material having a great inclination angle was loaded, an attitude of the ring material was tilted during the ring-rolling due to a difference in peripheral speed between the main roll and the ring material; however, when the slope angle was in such a range that the tilt of the ring material is not constrained, stability of rotation of the ring material was achieved. The rolling stability and generation of a defect showed the same trend to a certain degree.

Specifically, from the results shown in Table 1 and Table 2, it is observed that, regardless of the inclination angle of the ring material, when both of the lower face and the upper face formed on the main roll had the slope angle in a range of no less than 0.5° and less than 3°, the rolling stability was superior and the number of defects was small. In particular, in the case in which the inclination angle of the ring material was no greater than 10°, the rolling stability was superior when the slope angle was in a range of greater than 0.3° and less than 3°, and both of the rolling stability and defect prevention were remarkably superior when the slope angle was in a range of no less than 0.5° and less than 2°. In addition, in the case in which the inclination angle of the ring material was greater than 10°, the rolling stability was superior when the slope angle was in a range of no less than 0.6° and no greater than 9°, and both of the rolling stability and defect prevention were remarkably superior when the slope angle was in a range of no less than 1° and less than 3°.

REFERENCE SYMBOLS LIST

1: Ring material
10: Main roll
11: First flange portion (Upper flange portion)
11S: First inner face (Upper face)
12: Recessed portion
12S: Rolling face
13: Second flange portion (Lower flange portion)
13S: Second inner face (Lower face)
20: Mandrel roll
30: Axial roll

The invention claimed is:

1. A method of manufacturing a ring-rolled member comprising ring-rolling a ring material with a ring-rolling device, an outer peripheral face of the ring material being at least partially inclined with respect to a central axis of the ring material, the ring-rolling device comprising a main roll and a mandrel roll, the main roll being positioned on an outer peripheral side of the ring material, the mandrel roll being positioned on an inner peripheral side of the ring material, wherein an outer peripheral face of the main roll includes a recessed portion to accommodate the ring material and an outer peripheral face of the mandrel roll, a first flange portion positioned on one side in a central axis direction of the main roll with respect to the recessed portion, and a second flange portion positioned on an opposite side of the first flange portion; an inner face of the recessed portion includes a rolling face to be in contact with an outer peripheral face of the ring material, a first inner face on a side of the first flange portion, and a second inner face on a side of the second flange portion; at least one inner face among the first inner face and the second inner face has a slope in such a way that an opening of the recessed portion is enlarged, with reference to a perpendicular plane perpendicularly intersecting the central axis direction of the main roll; the slope starts from within a range of a distance corresponding to a thickness of the ring-rolled member from a line of intersection between the at least one inner face and the rolling face; and an angle of the slope is greater than 0.3° and no greater than 9° with reference to the perpendicular plane.

2. The ring-rolled member manufacturing method according to claim 1, wherein the ring material is a heat-resistant alloy, which is a Ni-based alloy, a Co-based alloy, or an Fe-based alloy.

3. The ring-rolled member manufacturing method according to claim 1, wherein an angle between a straight line connecting an end face corner of a large-diameter outer periphery with an end face corner of a small-diameter outer periphery of the ring material and the central axis of the ring material is greater than 10°.

4. The ring-rolled member manufacturing method according to claim 3, wherein the angle of the slope of the inner face is no less than 0.6° and no greater than 9° with reference to the perpendicular plane.

5. The ring-rolled member manufacturing method according to claim 1, wherein the outer peripheral face of the ring material is at least partially inclined with respect to a central axis of the ring material; and, when an angle between a straight line D connecting an end face corner LD of a large-diameter outer periphery with an end face corner SD of a small-diameter outer periphery of the ring material and the central axis of the ring material is no greater than 10°, the angle of the slope of the inner face is greater than 0.3° and less than 3° with reference to the perpendicular plane.

* * * * *